US007574752B1

(12) United States Patent
Walters

(10) Patent No.: US 7,574,752 B1
(45) Date of Patent: Aug. 18, 2009

(54) GARMENT WITH INTEGRAL FAUX THONG EXTENSION AND ASSOCIATED METHOD

(76) Inventor: Patrick Walters, 1019 Raymond Ave., Long Beach, CA (US) 90804

( * ) Notice: Subject to any disclaimer, the term of this patent is extended or adjusted under 35 U.S.C. 154(b) by 0 days.

(21) Appl. No.: 12/215,973

(22) Filed: Jul. 1, 2008

Related U.S. Application Data

(60) Provisional application No. 60/958,437, filed on Jul. 6, 2007.

(51) Int. Cl.
*A41D 1/06* (2006.01)

(52) U.S. Cl. ..... 2/227; 2/228; 2/406

(58) Field of Classification Search ..... 2/227, 2/228, 238, 400–408, 69, 79, 78.1–78.4, 2/73, 220, 221, 236, 237
See application file for complete search history.

(56) References Cited

U.S. PATENT DOCUMENTS 4,069,513 A 1/1978 Shiller
4,561,121 A * 12/1985 Ehring et al. ..... 2/455
5,010,595 A * 4/1991 Stradley ..... 2/227
5,168,582 A * 12/1992 Aldridge ..... 2/305
5,289,590 A * 3/1994 Larson ..... 2/227
5,499,404 A * 3/1996 Marchiorello ..... 2/403
5,689,832 A * 11/1997 Head ..... 2/227
5,888,118 A 3/1999 Kishi
6,202,220 B1 * 3/2001 Rhoden ..... 2/236
6,243,880 B1 * 6/2001 Lyden ..... 2/228
6,303,338 B1 * 10/2001 Ni et al. ..... 435/69.2
6,859,944 B2 3/2005 Kim
6,922,849 B1 * 8/2005 Fedrick ..... 2/227
7,124,448 B2 * 10/2006 Davenport ..... 2/229

* cited by examiner

*Primary Examiner*—Gloria Hale

(57) ABSTRACT

A combined leg wear and faux underwear garment preferably includes a leg wear and faux underwear disposed along an interior surface of the leg wear. The combined garment may further include a first cord engaged with the top-most end of the faux underwear. The faux underwear is disposed along an interior surface of the leg wear such that a bottom-most end of the faux underwear is hidden below the waist line of the leg wear while a top-most end of the faux underwear is exposed above the waist line of the leg wear. The faux underwear is automatically adapted between stretched and equilibrium positions when the waist line of the leg wear drops below and rises above the exposed end of the user buttock crevice respectively such that the faux underwear remains continuously positioned over the exposed end of the user buttock crevice.

9 Claims, 1 Drawing Sheet

GARMENT WITH INTEGRAL FAUX THONG EXTENSION AND ASSOCIATED METHOD

CROSS REFERENCE TO RELATED APPLICATIONS

This application claims the benefit of U.S. Provisional Application No. 60/958,437, filed Jul. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to leg wear and, more particularly, to a combined leg wear and faux underwear garment for covering an exposed portion of a user buttock crevice.

2. Prior Art

In the fashion trendy world of today it is of utmost importance to stay current with all the latest fashion statements. This is especially true for women, and not just adults, but even young teenagers. At such a young age, girls like to express themselves in how they dress and by trying out all the latest styles. The problem is that, at times, some fashion statements are not appropriate for young women of all ages. Recently, there has been a trend among celebrities and other influential persons in the fashion world to simultaneously wear low-cut jeans and thong undergarments, also known as G-strings. This combination causes the top border of the thong to extend beyond the top edge of the low-cut jeans for a more "sexy" look. Needless to say, mothers and not to mention fathers, of teenaged and younger girls do not wish for their daughters to dress in this manner. At the same time the young teenage girl has a great desire to look and dress similar to persons they see on television, movies and in fashion magazines.

U.S. Pat. No. 4,069,513 to Shiller discloses an outer garment including an outer portion intended to embrace the lower torso, an internal body hugging portion made of power net having front and rear sections, means securing the outer portion to the internal portion approximately about the waistline and longitudinally downwardly from the waistline approximately centrally of the front of the garment, and means in the area of the crotch securing the front and rear sections of the internal portion in relative positions to one another and defining individual leg holes for the wearer's feet. Advantageously the outer portion is a pair of stretch trousers knit of textured polyester multifilament yarns, the power net is more stretchable longitudinally than transversely and the power net is also secured to the rear of the trousers along a central longitudinal line. The power net, with the front and rear extending to the crotch, may be stitched fully lengthwise to meet at a point or be joined into a full crotchpiece. Unfortunately, this prior art example does not provide a comfortable and casual method for following the latest fashion trends.

U.S. Pat. No. 5,888,118 to Kishi discloses a garment having an inner lining for adjusting body shape of the buttocks and the abdomen. The garment is formed by combining woven fabrics together, each of which has a modulus of expansibility depending on a stretch direction from the weaving direction of the fabric. The buttocks regulating piece is oriented in a direction that the direction of the high modulus of expansibility of the fabric is selected to gather and push up the buttocks and is sewed between the front body and the back body, while an abdominal regulating piece is formed of at least two sheets, each oriented so that the direction of the low modulus of expansibility of the fabric is in the lateral direction to the abdomen. The sheets are sewed onto the front body so as to at least artially overlap each other within the abdominal region including the lower abdominal region. Unfortunately, this prior art example does not enable a user to follow the latest fashion trends while simultaneously maintaining a sense of modesty.

U.S. Pat. No. 6,859,944 to Kim discloses a device and article of clothing to adjust the article to reveal a portion of the body such as an abdominal area. In the preferred embodiment, a means for adjusting includes a cinch device including an elastic cord with mating snaps on the cord, and an article of clothing. The cord is attached through an adjustable section of material in a manner to permit the material to be gathered or bunched together when the cord is drawn. The cinch is selectively securable by the snaps in one or more positions. In a preferred pants embodiment of the invention, the adjustment changes the distance between the waistline and crotch of the pants to increase or decrease the distance between the waistline and crotch to variably cover or reveal the lower abdominal area of the wearer. Unfortunately, this prior art example does not enable a user to follow the latest fashion trends while simultaneously maintaining a sense of modesty.

Accordingly, the present invention is disclosed in order to overcome the above noted shortcomings. The assembly is convenient and easy to use, lightweight yet durable in design, and designed for covering an exposed portion of a user buttock crevice. The present invention is simple to use, inexpensive, and designed for many years of repeated use.

BRIEF SUMMARY OF THE INVENTION

In view of the foregoing background, it is therefore an object of the present invention to provide an apparatus for covering an exposed portion of a user buttock crevice. These and other objects, features, and advantages of the invention are provided by a combined leg wear and faux underwear garment.

A combined leg wear and faux underwear garment preferably includes a leg wear that effectively has a waist line formed along a top-most edge thereof. Such a leg wear is preferably adapted to partially cover a user buttock in such a manner that the waist line of the leg wear may be selectively situated below the exposed end of the user buttock crevice during use thereof. The leg wear preferably includes a sleeve formed along an anterior section of the waist line and positioned along the interior surface of the leg wear. Such a sleeve is preferably provided with opposed orifices through which the first cord is interfitted and passed such that the anterior section of the first cord is prohibited from displacing above the waist line of the leg wear.

The assembly may further include faux underwear conveniently disposed along an interior surface of the leg wear such that a bottom-most end of the faux underwear is preferably hidden below the waist line of the leg wear while a top-most end of the faux underwear is exposed above the waist line of the leg wear. A bottom-most end of the faux garment may be fixedly attached directly to the interior surface of the leg wear. Such a bottom-most end of the faux garment is preferably centrally and statically aligned with the user buttock crevice. Each of the top-most and the bottom-most ends of the faux underwear may be provided with a corresponding sleeve spanning along an entire lateral width thereof respectively. Such a sleeve of the top-most end of the faux underwear is preferably slidably and laterally engaged about a posterior section of the first cord.

The assembly may further include a first cord engaged with the top-most end of the faux underwear. Such a first cord preferably contiguously extends adjacent to an entire circumference of the waist line of the leg wear. The first cord may be monolithically formed with the top-most end of the faux underwear, and a posterior section of the first cord is preferably exposed above the waist line of the leg wear while an anterior section of the first cord may advantageously be hidden inside an anterior section of the leg wear. Such a posterior section of the first cord as well as opposed lateral sections of the first cord preferably remain continuously seated above the waist line of the leg wear.

The faux underwear may be automatically adapted between stretched and equilibrium positions when the waist line of the leg wear drops below and rises above the exposed end of the user buttock crevice respectively such that the faux underwear preferably remains continuously positioned over the exposed end of the user buttock crevice while the waist line of the leg wear may effectively be selectively adapted below the exposed end of the user buttock crevice respectively. The faux underwear is preferably selected from a group including a faux g-string and a faux thong respectively.

The assembly may further include a second cord that conveniently has opposed ends anchored to the interior surface of the leg wear and disposed subjacent to the waist line thereof. Such a second cord is preferably slidably interfitted and passed through the sleeve of the bottom-most end of the faux underwear such that the faux underwear may be laterally biased along respective longitudinal lengths of the first and second cords and thereby may be laterally offset along a posterior section of the waist line of the leg wear.

The assembly may further include a plurality of fasteners statically coupled directly to the second cord, and a plurality of latches may be statically coupled directly to the interior surface of the leg wear and spaced apart at alternate positions subjacent to the waist line of the leg wear. Such fasteners are preferably detachably engaged with associated ones of such latches such that an anchored position of the bottom-most end of the faux underwear may be selectively offset from a center of the posterior section of the waist line.

A preferred method for covering an exposed portion of a user buttock crevice may include the steps of: providing a leg wear that has a waist line formed along a top-most edge thereof; providing and disposing a faux underwear along an interior surface of the leg wear such that a bottom-most end of the faux underwear is hidden below the waist line of the leg wear while a top-most end of the faux underwear is exposed above the waist line of the leg wear, the faux underwear being selected from a group including a faux g-string and a faux thong respectively; providing and engaging a first cord with the top-most end of the faux underwear, the first cord contiguously extending adjacent to an entire circumference of the waist line of the leg wear; adapting the leg wear to partially cover a user buttock in such a manner that the waist line of the leg wear is selectively situated below the exposed end of the user buttock crevice during use thereof; and automatically adapting the faux underwear between stretched and equilibrium positions when the waist line of the leg wear drops below and rises above the exposed end of the user buttock crevice respectively such that the faux underwear remains continuously positioned over the exposed end of the user buttock crevice while the waist line of the leg wear is selectively adapted below the exposed end of the user buttock crevice respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
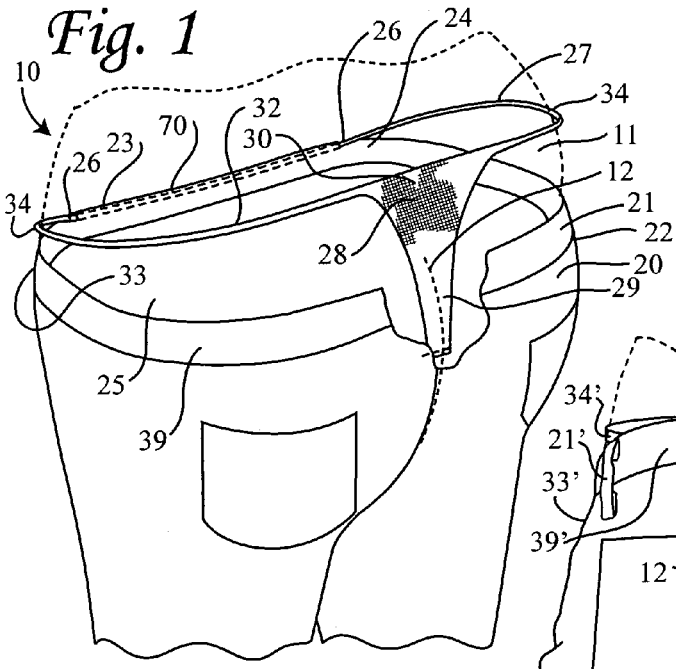
FIG. 1 is a rear perspective view of a preferred embodiment of the combined leg wear and faux underwear garment in use, in accordance with the present invention.
Figure 2:
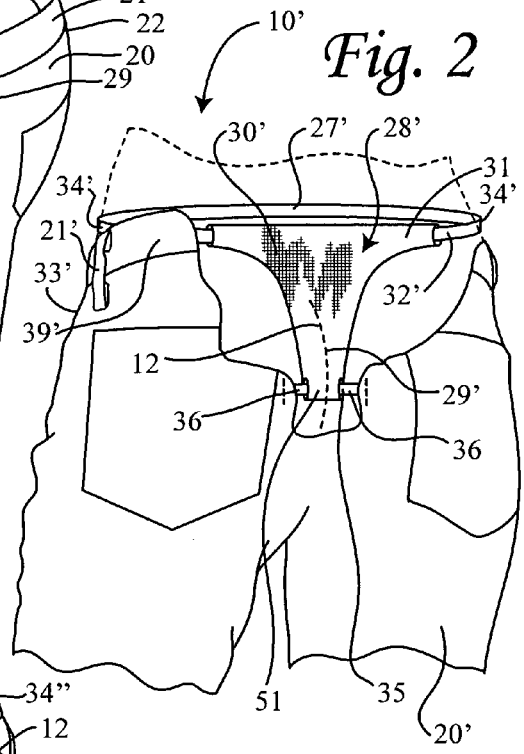
FIG. 2 is a rear perspective view of an alternate embodiment of the combined leg wear and faux underwear garment in use, in accordance with the present invention.
Figure 3:
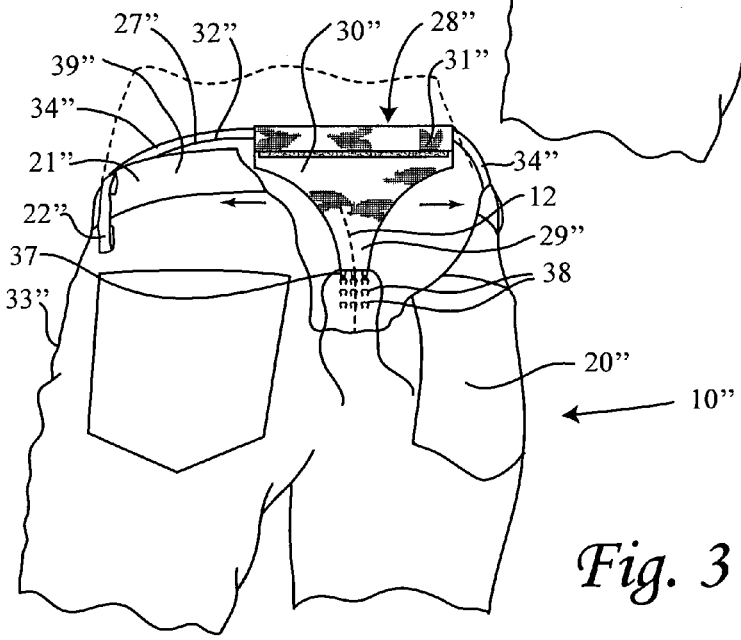
FIG. 3 is a rear perspective view of a third embodiment of the combined leg wear and faux underwear, in accordance with the present invention.

The assembly of this invention is referred to generally in FIGS. 1-3 by the reference numeral 10, 10', 10" and is intended to provide a combined leg wear and faux underwear garment. It should be understood that the assembly 10 may be used with many different types of leg wear and should not be limited to use with only those types of leg wear mentioned herein, such as jeans for example.

Referring initially to FIGS. 1-3, a combined leg wear and faux underwear garment 10, 10', 10" preferably includes a leg wear 20, 20', 20" that has a waist line 21, 21', 21" formed along a top-most edge 22 thereof. Such a leg wear 20, 20', 20" is preferably adapted to partially cover a user buttock 11 in such a manner that the waist line 21, 21', 21" of the leg wear 20, 20', 20" may be selectively situated below the exposed end of the user buttock crevice 12 during use thereof. One skilled in the art understands that the waist line 21, 21', 21" will drop below the buttock crevice 12 when a user bends over or squats, for example. Therefore, although FIGS. 1-3 don't show the waist line situated below the buttock crevice 12, it is apparent understood that conventional leg wear such as jeans have this problem.

In one embodiment 10, as shown in FIG. 1, the leg wear 20 preferably includes a sleeve 23 formed along an anterior section 24 of the waist line 21 and positioned along the interior surface 25 of the leg wear 20. Such a sleeve 23 is preferably provided with opposed orifices 26 through which a first cord 27 (as referenced hereinafter) is interfitted and passed which is essential such that an anterior section 70 of the first cord 27 is prohibited from displacing above the waist line 21 of the leg wear 20. The combination of the sleeve 23 and the first cord 27 advantageously provides the unpredictable and unexpected result of ensuring that the first cord 27 remains suitably attached to the leg wear 20 during use.

Referring to FIGS. 1 through 3, the combined garment 10, 10', 10" may further include faux underwear 28, 28', 28" disposed along an interior surface 25 of the leg wear 20, 20', 20" which is vital such that a bottom-most end 29, 29', 29" of the faux underwear 28, 28', 28" is preferably hidden below the waist line 21, 21', 21" of the leg wear 20, 20', 20" while a top-most end 30, 30', 30" of the faux underwear 28, 28', 28" is exposed above the waist line 21, 21', 21" of the leg wear 20, 20', 20".

In the embodiment 10 shown in FIG. 1, the bottom-most end 29 of the faux garment 28 may be fixedly attached directly, without the use of intervening elements, to the interior surface 25 of the leg wear 20. Such a bottom-most end 29 of the faux garment 28 is preferably centrally and statically aligned with the user buttock crevice 12.

In an alternate embodiment 10' shown in FIG. 2, each of the top-most 30' and the bottom-most ends 29' of the faux underwear 28' may be provided with a corresponding sleeve 31, 51 spanning along an entire lateral width thereof respectively. Such a sleeve 31 of the top-most end 30' of the faux underwear 28' is preferably slidably and laterally engaged about a posterior section 32' of the first cord 27'. Such an embodiment provides the unexpected benefit of enabling the faux underwear 28' to be automatically adapted side-to-side along the waist line 21' as the user twists and turns to that the faux underwear continuously covers the buttock crevice and maintains a substantially symmetrical shape when it is stretched, for example.

Referring again to FIG. 1, for example, the first cord 27, 27', 27' is engaged with the top-most end 30, 30', 30" of the faux underwear 28, 28', 28". Such a first cord 27, 27', 27" preferably contiguously extends adjacent to an entire circumference of the waist line 21, 21', 21" of the leg wear 20, 20', 20".

In the embodiment 10 shown in FIG. 1, the first cord 27 may be monolithically formed with the top-most end 30 of the faux underwear 28. Further, each embodiment 10, 10', 10" permits a posterior section 32, 32', 32" of the first cord 27, 27', 27" to be preferably exposed above the waist line 21, 21', 21" of the leg wear 20, 20', 20". As an example, embodiment 10 permits an anterior section 70 of the first cord 27 to be hidden inside an anterior section 33 of the leg wear 20. Of course, in order to provide a sexy and aesthetically appealing garment, all embodiments 10, 10', 10" are adaptable in such a manner that respective posterior sections 32, 32', 32" of the first cord 27, 27', 27" as well as respective lateral sections 34, 34', 34" of the first cord 27, 27', 27" preferably remain continuously seated above the waist line 21 of the leg wear 20, 20', 20". It is noted that although first cord 27' is not completely disposed above the waist line 27', one skilled in the art understands that it is easily adaptable to such an exposed position, similar to the first cords 27, 27" shown in FIGS. 1 and 3.

The faux underwear 28, 28', 28" may be automatically adapted between stretched and equilibrium positions when the waist line 21, 21', 21" of the leg wear 20, 20', 20" drops below and rises above the exposed end of the user buttock crevice 12 respectively which is crucial such that the faux underwear 28, 28', 28" preferably remains continuously positioned over the exposed end of the user buttock crevice 12 while the waist line 21, 21', 21" of the leg wear 20, 20', 20" may be selectively adapted below the exposed end of the user buttock crevice 12 respectively. One skilled in the art understands that such an automatic stretching function is achieved by formed the faux underwear 28, 28', 28" from elastic material that has resilient properties, for example. The faux underwear 28, 28', 28" is preferably selected from a group including a faux g-string and a faux thong respectively. Of course, many suitable styles, shape and sizes of faux underwear may be employed without departing from the true scope of the present invention.

Referring to FIG. 2, the combined garment 10' may further include a second cord 35 that has opposed ends 36 anchored to the interior surface 25 of the leg wear 20' and disposed subjacent to the waist line 21' thereof. Such a second cord 35 is preferably slidably interfitted and passed through sleeve 51 of the bottom-most end 29' of the faux underwear 28' which is essential such that the faux underwear 28' may be laterally biased along respective longitudinal lengths of the first and second cords 27', 35 and thereby may be laterally offset along a posterior section 39' of the waist line 21' of the leg wear 20'. The second cord 35 provides a user with the unexpected benefit of ensuring that the faux underwear 28 remains securely attached to the leg wear 20' during twisting and turning movements, for example.

Referring to FIG. 3, the assembly 10" may further include a plurality of fasteners 37 statically coupled directly, without the use of intervening elements, to the bottom-most end 29" of the faux underwear 28". A plurality of latches 38 may be statically coupled directly, without the use of intervening elements, to the interior surface 25 of the leg wear 20" and spaced apart at alternate positions subjacent to the waist line 21" of the leg wear 20". Such fasteners 37 are preferably detachably engaged with associated ones of such latches 38, which is vital such that an anchored position of the bottom-most end 29" of the faux underwear 28" may be selectively offset from a center of the posterior section 39" of the waist line 21". The fasteners 37 advantageously provide an alternate mechanism for ensuring that the bottom-most end 29" of the faux underwear 28" remains securely attached to the leg wear 20" during use and advantageously permit the user to quickly and easily adapt the anchored position of the faux underwear 28" as desired during bending, squatting, twisting, turning or other movements, for example.

In operation, a preferred method for covering an exposed portion of a user buttock crevice 12 may include the steps of: providing a leg wear 20, 20', 20" that has a waist line 21, 21', 21" formed along a top-most edge 22 thereof; providing and disposing a faux underwear 28, 28', 28" along an interior surface 25 of the leg wear 20, 20', 20" such that a bottom-most end 29, 29', 29" of the faux underwear 28, 28', 28" is hidden below the waist line 21, 21', 21" of the leg wear 20, 20', 20" while a top-most end 30, 30', 30" of the faux underwear 28, 28', 28" is exposed above the waist line 21, 21', 21" of the leg wear 20, 20', 20". The faux underwear 28, 28', 28" is selected from a group including a faux g-string and a faux thong respectively. The method further includes the step of providing and engaging a first cord 27, 27', 27" with the top-most end 30, 30', 30" of the faux underwear 28, 28', 28", wherein the first cord 27, 27', 27" contiguously extends adjacent to an entire circumference of the waist line 21, 21', 21" of the leg wear 20, 20', 20". The method may further include the steps of adapting the leg wear 20, 20', 20" to partially cover a user buttock 11 in such a manner that the waist line 21, 21', 21" of the leg wear 20, 20', 20" is selectively situated below the exposed end of the user buttock crevice 12 during use thereof; and automatically adapting the faux underwear 28, 28', 28" between stretched and equilibrium positions when the waist line 21, 21', 21" of the leg wear 20, 20', 20" drops below and rises above the exposed end of the user buttock crevice 12 respectively such that the faux underwear 28, 28', 28" remains continuously positioned over the exposed end of the user buttock crevice 12 while the waist line 21, 21', 21" of the leg wear 20, 20', 20" is selectively adapted below the exposed end of the user buttock crevice 12 respectively.

The combined garment 10, 10', 10" of the present invention may include a leg wear 20, 20', 20" that has a faux g-string type or thong type faux underwear 28, 28', 28" directly attached, without the use of intervening elements, to the leg wear 20, 20', 20" and displayed above the waistline 21, 21', 21" thereof. Such a leg wear 20, 20', 20" is preferably produced of a durable, heavyweight denim material. Of course, the leg wear 20, 20', 20" could be offered in a wide variety of styles, like tight, loose, baggy, flare and destroyed style jeans, as is obvious to a person of ordinary skill in the art. The faux underwear 28, 28', 28" may include a first cord 27, 27', 27" that is sewn into the waistband 21, 21', 21" of the leg wear 20, 20', 20" and extends outwardly thereof. The faux underwear 28, 28', 28" may preferably be produced of a durable material, like linen or cotton. Of course, the faux underwear 28, 28', 28" could be offered in a vast array of colors and fabrics to appeal to individual taste and style, as is obvious to a person of ordinary skill in the art.

The present invention, as claimed, provides the unexpected and unpredictable benefit of a combined garment that is convenient and easy to use, is durable yet lightweight in design, and offers young girls a unique and stylish way to express themselves through fashion that also helps them to maintain a sense of modesty. By offering a variety of sizes, the present invention allows teens and young adults to visibly display a comfortable, casual new look based on a very popular fashion statement. In this manner, the combined garment provides a simple, affordable way to follow trends while still maintaining one's own personal style, as well as covering an area they wish not to overexpose. As such, when wearing this combined garment, a young girl can comfortably sit, stoop, or do whatever she needs without embarrassment.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined leg wear and faux underwear garment for covering an exposed portion of a user buttock crevice, said combined leg wear and faux underwear garment comprising:

a leg wear having a waist line formed along a top-most edge thereof, said leg wear being adapted to partially cover a user buttock in such a manner that said waist line of said leg wear is selectively situated below an exposed end of the user buttock crevice during use thereof, said leg wear including a lower torso buttocks covering garment provided with a crotch and leg portions respectively;

a faux underwear garment disposed along an interior surface of said leg wear such that a bottom-most end of said faux underwear garment is attached to said leg wear at a location below said waist line of said leg wear while a top-most end of said faux underwear garment is exposed above said waist line of said leg wear; and a first cord engaged with said top-most end of said faux underwear garment such that a posterior section of said first cord is abutted to said top-most end of said faux underwear garment, said first cord contiguously extending adjacent to an entire circumference of said waist line of said leg wear;

wherein said faux underwear garment is automatically adapted between stretched and equilibrium positions when said waist line of said leg wear drops below and rises above the exposed end of the user buttock crevice respectively such that said faux underwear garment remains continuously positioned over the exposed end of the user buttock crevice;

wherein said posterior section of said first cord remains abutted to said top-most end of said faux underwear garment as said faux underwear garment is adapted between the stretched and equilibrium positions.

2. The combined leg wear and faux underwear garment of claim 1, wherein said first cord is formed with said top-most end of said faux underwear garment, a posterior section of said first cord being exposed above said waist line of said leg wear while an anterior section of said first cord is hidden inside an anterior section of said leg wear.

3. The combined leg wear and faux underwear garment of claim 2, wherein said leg wear comprises: a sleeve formed along an anterior section of said waist line and positioned along said interior surface of said leg wear, said sleeve being provided with opposed orifices through which said first cord is interfitted and passed such that said anterior section of said first cord is prohibited from displacing above said waist line of said leg wear.

4. The combined leg wear and faux underwear garment of claim 3, wherein said posterior section of said first cord as well as opposed lateral sections of said first cord remain continuously seated above said waist line of said leg wear.

5. The combined leg wear and faux underwear garment of claim 1, wherein said bottom-most end of said faux underwear garment defines a point fixedly attached directly to said interior surface of said leg wear, said point of said bottom-most end of said faux underwear garment being centrally and statically aligned with the user buttock crevice.

6. The combined leg wear and faux underwear garment of claim 1, wherein each of said top-most and said bottom-most ends of said faux underwear garment are provided with a corresponding sleeve spanning along an entire lateral width thereof respectively, said sleeve of said top-most end of said faux underwear garment being slidably and laterally engaged about said posterior section of said first cord.

7. The combined leg wear and faux underwear garment of claim 6, further comprising: a second cord having opposed ends anchored to said interior surface of said leg wear and disposed subjacent to said waist line thereof, said second cord being slidably interfitted and passed through said sleeve of said bottom-most end of said faux underwear garment such that said faux underwear garment is laterally biased along respective longitudinal lengths said first and second cords and thereby is laterally offset along a posterior section of said waist line of said leg wear.

8. The combined leg wear and faux underwear garment of claim 7, further comprising:

a plurality of fasteners statically coupled directly to said second cord; and a plurality of latches statically coupled directly to said interior surface of said leg wear and spaced apart at alternate positions subjacent to said waist line of said leg wear;

where said fasteners are detachably engaged with associated ones of said latches such that an anchored position of said bottom-most end of said faux underwear garment is selectively offset from a center of said posterior section of said waist line.

9. A method for covering an exposed portion of a user buttock crevice, said method comprising the steps of:

a. providing a leg wear having a waist line formed along a top-most edge thereof, said leg wear including a lower torso buttocks covering garment provided with a crotch and leg portions respectively;

b. providing and disposing a faux underwear garment along an interior surface of said leg wear such that a bottom-most end of said faux underwear garment is attached to said leg wear at a location below said waist line of said leg wear while a top-most end of said faux underwear garment is exposed above said waist line of said leg wear, said faux underwear garment being selected from a group including a faux g-string and a faux thong respectively;

c. providing and engaging a first cord with said top-most end of said faux underwear garment such that a posterior section of said first cord remains abutted to said top-most end of said faux underwear garment, said first cord contiguously extending adjacent to an entire circumference of said waist line of said leg wear;

d. adapting said leg wear to partially cover a user buttock in such a manner that said waist line of said leg wear is selectively situated below the exposed end of the user buttock crevice during use thereof; and e. automatically adapting said faux underwear garment between stretched and equilibrium positions when said waist line of said leg wear drops below and rises above the exposed end of the user buttock crevice respectively such that said faux underwear garment remains continuously positioned over the exposed end of the user buttock crevice while said waist line of said leg wear is selectively adapted below the exposed end of the user buttock crevice respectively;

wherein said posterior section of said first cord remains abutted to said top-most end of said faux underwear garment as said faux underwear garment is adapted between the stretched and equilibrium positions.

* * * * *